United States Patent [19]

Zouhar et al.

[11] 4,070,874

[45] Jan. 31, 1978

[54] ONE PIECE PANTYHOSE AND METHOD OF MANUFACTURING SAME

[75] Inventors: Drahomir Zouhar, Blansko; Antonin Holas; Ivan Musil, both of Brno, all of Czechoslovakia

[73] Assignee: Elitex - Zavody textilniho strojirenstvi generalni reditelstvi, Liberec, Czechoslovakia

[21] Appl. No.: 636,432

[22] Filed: Dec. 1, 1975

[30] Foreign Application Priority Data

Dec. 12, 1974 Czechoslovakia ..... 8472/74

[51] Int. Cl.[2] ..... A41B 9/08

[52] U.S. Cl. ..... 66/177

[58] Field of Search ..... 66/177

[56] References Cited

U.S. PATENT DOCUMENTS

| | | | |
|---|---|---|---|
| 2,511,720 | 6/1950 | Lacks | 66/177 |
| 3,128,475 | 4/1964 | Rice | 66/177 X |
| 3,802,229 | 4/1974 | Fregealle | 66/177 |
| 3,815,385 | 6/1974 | Gariboldi | 66/177 X |
| 3,924,423 | 12/1975 | Lonati | 66/177 X |
| 3,937,039 | 2/1976 | Anderson | 66/177 |
| 3,937,040 | 2/1976 | Negri | 66/177 |
| 3,938,355 | 2/1976 | Conti | 66/177 X |
| 3,946,579 | 3/1976 | Heining | 66/177 |
| 3,975,924 | 8/1976 | Furia | 66/177 X |
| 4,011,738 | 3/1977 | Furia | 66/177 X |

FOREIGN PATENT DOCUMENTS

| | | | |
|---|---|---|---|
| 2,201,766 | 8/1972 | Germany | 66/177 |
| 2,142,616 | 3/1972 | Germany | 66/177 |

*Primary Examiner*—Mervin Stein
*Assistant Examiner*—Andrew M. Falik

[57] ABSTRACT

Panties including two tubular limb portions and a tubular body portion formed and joined in a circular knitting machine, wherein the tubular limb portions have their same sides situated outside and are joined on one hand by the body tubular portion and on the other hand are mutually joined. The tubular limb portions may be connected by means of a part in the form of a closed toe.

Method of manufacturing the above panties, wherein successively there are knitted and retained three tubular portions of panties mutually slipped into each other in such manner that the tubular portion for the body part is situated between two tubular limb portion. The tubular portion for the body part is joined by knitting on one part of the border circumference with the adjacent part of the border of one tubular limb portions situated at its outer side, and on the other part of the border circumference with the adjacent part of the border of a tubular limb portion situated at its inner side. Said tubular limb portions are mutually circumferentially joined on the remaining parts of the border by being knitted in the form of a closed toe, the mutual joining of the tubular limb portions being performed after joining the tubular portion for the body part with the tubular limb portion situated at its inner side.

5 Claims, 35 Drawing Figures

ONE PIECE PANTYHOSE AND METHOD OF MANUFACTURING SAME

The present invention relates to panties having three tubular portions formed and mutually joined in a circular knitting machine, and to a method of manufacturing such panties.

Two different embodiments of panties of the type in question have been hitherto known. In the first type, the tubular limb portions are joined with the tubular portion for the body at circumferential parts thereof, while the remaining circumferential parts of the borders are free, thus forming an opening in the crotch part. This opening is closed in certain modifications of this embodiment by overlapping borders of the tubular limb portions.

In the second type of embodiment, the tubular portions for the limbs are joined in one part of the border by knitting with the border of the tubular portion for the body part, and are mutually joined in the second part of the border by a part formed in the shape of a closed toe, said tubular limb portions being different at their outer sides, i.e., one having its underside directed outside and the other having its face side directed outside.

The panties of the first type of embodiment are not fully satisfactory due to the opening in the crotch part. The second embodiment of the panties is unsatisfactory due to its appearance, as one of the tubular limb portions is reversed with respect to the second tubular limb portion and the tubular portion for the body part. This disadvantage in appearance is considerable; it may be partially mitigated by certain structures, but any patterning is practically impossible.

The present invention has an object in the provision of panties formed of three mutually joined tubular portions, such panties not having the disadvantages of the known embodiments of panties mentioned above and which can be manufactured with maximum facility in a circular knitting machine. The present invention also has as an object the provision of a suitable method of manufacturing said panties.

In the panties according to the present invention, the tubular limb portions are turned with the same sides thereof outside and are joined on the one hand with the tubular portion for the body part, and on the other hand, are joined with each other.

It is advantageous from the viewpoint of obtaining panties of good quality, as well as from the viewpoint of ease and economy of manufacture, to perform the mutual joining of the tubular limb portions by means of a part made in the form of a closed toe.

In an advantageous method of manufacturing the panties according to the present invention, three tubular portions of the panties are successively knitted and retained, said portions being surrounded by each other in such manner that the tubular portion for the body part is situated between the two tubular limb portions. The tubular body portion is joined by knitting on one part of the border circumference with the adjacent part of the border of the tubular limb portion situated at its inner side. Said tubular limb portions are mutually joined on the remaining parts of the border circumference by a part knitted in the form of a closed toe, the mutual joining of the tubular limb portions being performed after joining the tubular portion for the body part with the tubular limb portion located at the inner side thereof.

The tubular portions may be knitted in any sequence. However, it is advantageous to knit as the first portion a limb portion from its toe part and to retain it on the needles, thus making it possible to close the toes of both tubular limb portions directly in the machine.

In view of the simplicity of the embodiment of a circular knitting machine, it is advantageous to knit the tubular limb portion by using a part of the needles in the needle cylinder, and after an eventual securing of the border, said portion is retained on the needles in a continuous manner, the second tubular limb portion being knitted on the same number of needles and being retained after securing its border on the transfer jacks. The tubular portion for the body part is knitted by using all accessible needles. Said tubular portions are mutually joined by knitting after finishing the last portion, the tubular limb portion retained on the transfer jacks being transferred on the appurtenant part of the border circumference back to the needles upon actual joining.

From the viewpoint of simple needle patterning and the extensibility of joining it is advantageous to knit the tubular limb portions on the same needles and also to use the same number of needles upon forming the border, the previously knitted tubular limb portion being retained on other needles of the needle cylinder.

For the purpose of obtaining optimum use of the needles of the needle cylinder, and thus the optimum size of the panties and the shape of the tubular portions, all three tubular portions are advantageously knitted by using all needles of the needle cylinder, the tubular portions for the limbs being knitted first, and the portion thereof knitted as the first tubular limb portion being retained on the needle shanks in inoperative position, while the second knitted tubular limb portion is retained on the transfer jacks. Thereafter, the liberated needles are used for knitting the tubular portion for the body part and thereafter said tubular portions are joined by knitting, the second tubular portion for the limb being transferred during joining from the transfer jacks by parts to the needles and the first tubular limb portion being transmitted from the needle shanks from the inoperative to the operative position.

Also upon knitting tubular portions by using all needles, it is possible to avoid the retaining of a tubular limb portion on the transfer jacks during the knitting of the tubular portion for the body part by knitting a tubular limb portion, after securing the border retaining said portion on the shanks of only a part of the needles in inoperative position, and casting off the remaining needles, whereby all needles of the needle cylinder are free and the tubular portion for the body part is knitted by using all needles. Said portion is also retained on the shanks in inoperative position, a tubular limb portion being knitted by using all needles, one part of the circumference of the border thereof being retained on the transfer jacks and being knocked off the needles, while the second part of the border is joined with the tubular portion for the body parts and is then knocked off the needles, the tubular limb portion being displaced from the needle shanks into an operative position, joined with a part of the border circumference of the tubular portion for the body part. After knocking off the joined border parts, the remaining border parts of the respective tubular limb portions are transferred from the transfer jacks to the needles and the joining of both tubular limb portions is finished.

Further advantages and features of the present invention are evident in the embodiments in the form of an example shown diagrammatically in the accompanying drawings, in which.

Figure 13:
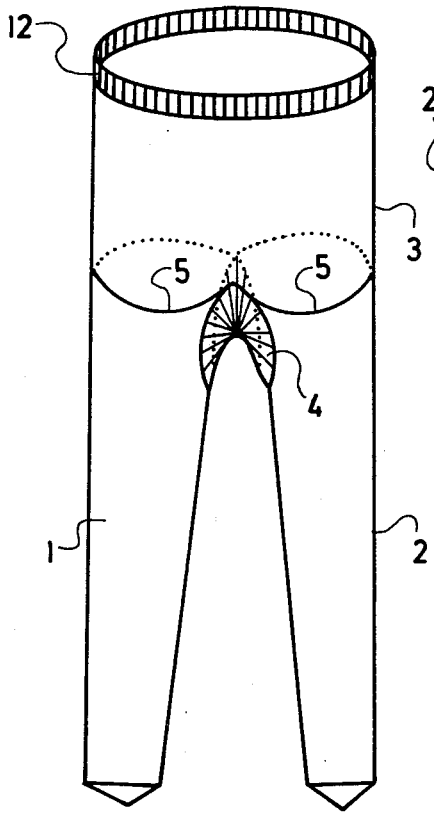
FIG. 13 is a view in perspective of the unfolded panties.

Turning to FIG. 13, it will be seen that the panties include three tubular portions, 1, 2 and 3. One of said tubular portions, i.e., portion 3, is intended for the body part of the panties, the remaining two tubular portions 1, 2 being intended for the limbs.

All tubular portions may be adapted in known manner to the body form. The tubular portions for the limbs are provided directly in the machine by closed toes and the tubular portion for the body part is provided by an elastic thread.

The panties according to the present invention are knitted in the circular knitting machine, e.g. in such manner that knitting is started from the toe 7 of the tubular limb portion 1, which may be closed directly in the machine.

The manner in which the toe portion 7 is formed is known, e.g., from U.S. Pat. Nos. 3,776,000 or 3,757,539, and employs the cooperation of a dial 6 (FIGS. 14–17) and a needle cylinder 9 of the knitting machine, which is assumed to be of the two-feed single cylinder type. In such machine, the needles 8 are movable axially between radially movable sinkers 6', such movement being controlled by the cam system described below.

Figure 16:
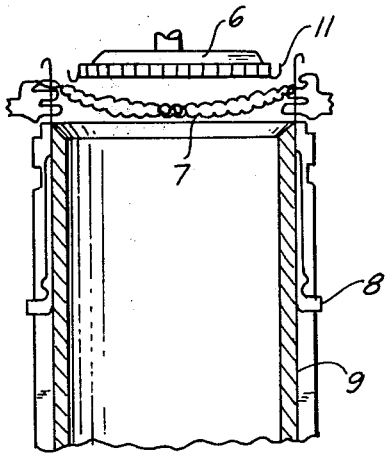
FIG. 16 is an elevational view in section similar to FIG. 14, illustrating the closed toe when the latter is transferred in toto to the needles of the cylinder.
Figure 17:
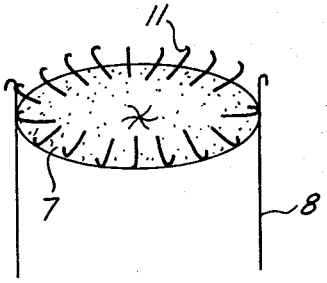
FIG. 17 is a perspective view of the upper portion of the arrangement of FIG. 16.

Specifically, the toe portion 7 is knitted in the form of a tube, with one border thereof carried on conventional transfer jacks 11 of the dial 6 and the other border carried on needles 8 supported on the needle cylinder 9. Upon a relative rotation of the dial 6 with respect to the needle cylinder 9 in a conventional manner, the tube is twisted (FIGS. 14–15), after which the border carried on the jacks 11 is transferred back onto the needles 8 (FIGS. 16–17).

Figure 18:
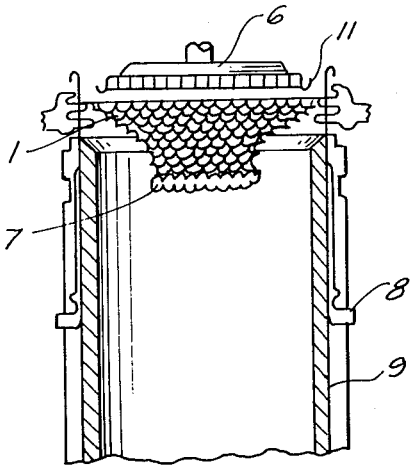
FIG. 18 is an elevational view in section of a knitting machine during the completion of manufacture of a first tubular limb portion of the panties after the closed toe portion shown in FIGS. 14–17 is finished.
Figure 19:
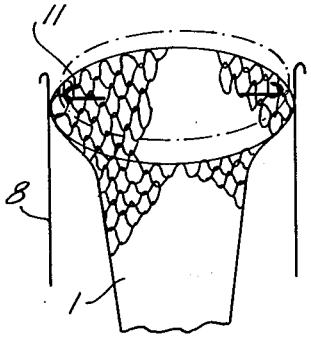
FIG. 19 is a perspective view of the upper portion of the arrangement of FIG. 18.

When the knitting of the toe portion 7 is completed, the knitting of the first tubular limb portion 1 is continued in a conventional manner as shown, e.g., in FIGS. 18–19.

Figure 20:
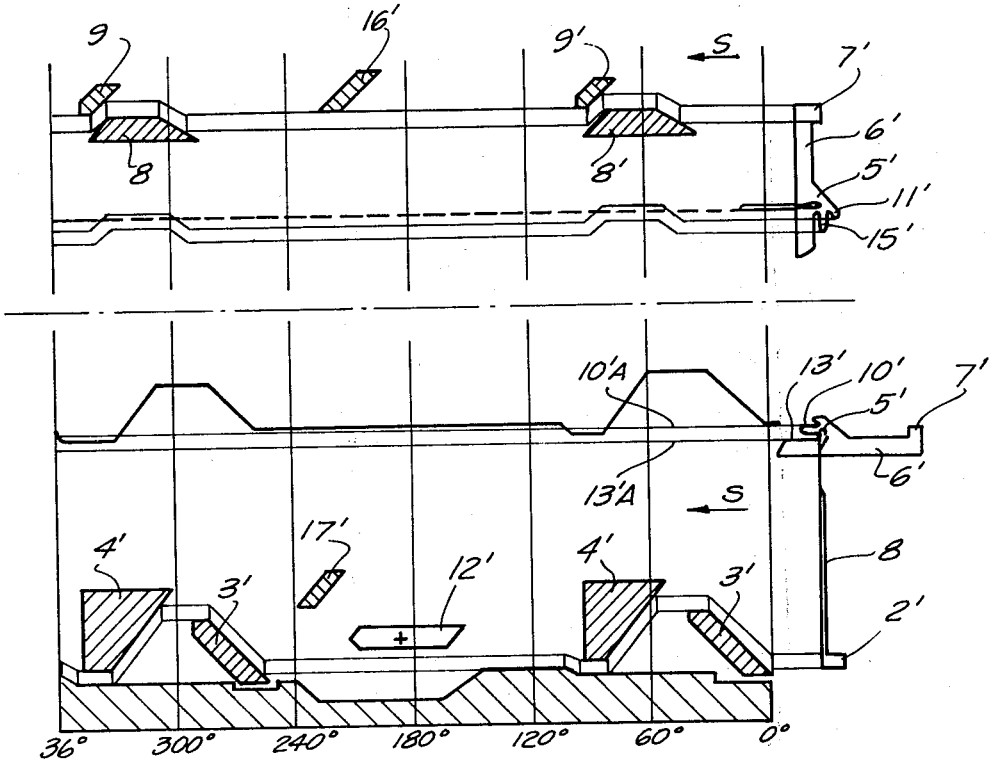
FIG. 20 is a schematic representation of an adjustable cam section for operating the sinkers and needles of the knitting machine, the cam system being adjusted for knitting the first tubular limb portion of FIGS. 18–19.
Figure 21:
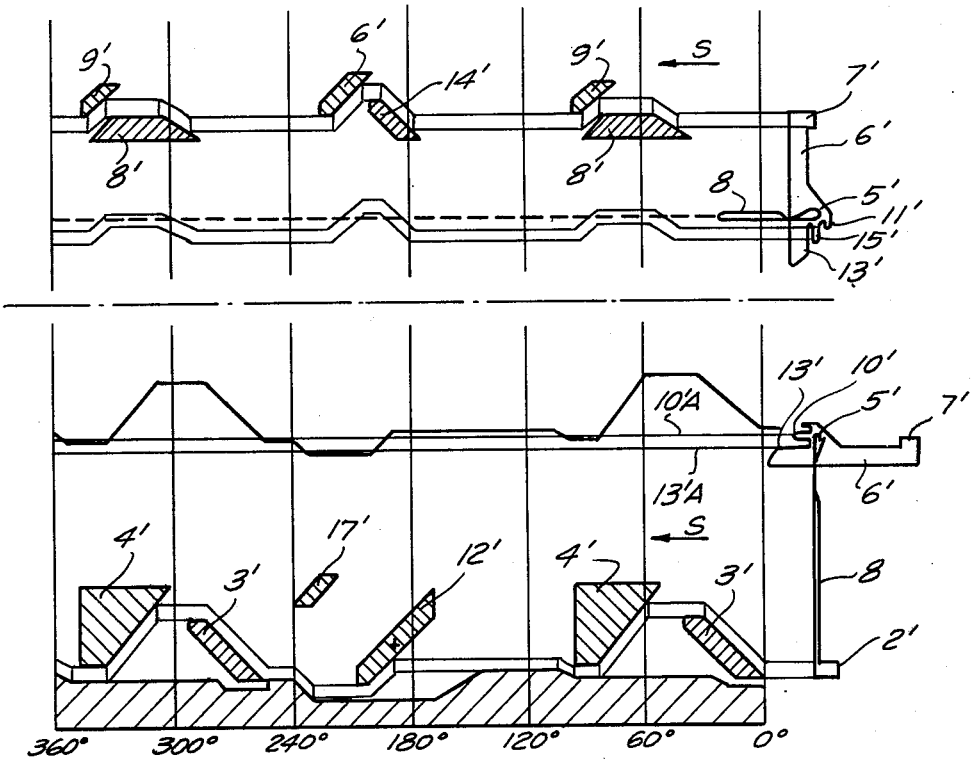
FIG. 21 is a schematic representation of the cam system of FIG. 20 when adjusted to transfer a just-knitted first limb portion of the panties into an inoperative position on the needle shanks so that the needles can be used in a new knitting operation.

FIG. 20 illustrates schematically a cam system of the circular knitting machine for the carrying out of the knitting of the main part of the tubular portion 1 of FIGS. 18–19. The portion of the cam system associated with the sinkers 6' (and which operate on their butts 7') includes a pair of bolt cams 8', a pair of knocking-over cams 9', a further bolt cam 14' (which is illustrated in FIG. 21 and which is not employed in the normal tubular knitting operation of FIG. 20), and an auxiliary sinker cam 16' (FIG. 20). The portion of the cam system associated with the needles 8, and which operates on the needle butts 2', includes a pair of needle raising cams 3', a pair of stationary, needle-lowering stitch cams 4', a three-position auxiliary cam 17', and an additional auxiliary cam 12', which is disposed horizontally as shown in FIG. 20 when the normal knitting operation of the tubular portion 1 is to be instrumented.

During the normal knitting of the tubular portion 1, the needles 8 and the sinkers 6' follow cyclical paths whose course, over 360°, is illustrated schematically in FIG. 20 under the control of the respective depicted cam systems. Movement of the heads 5' of the needles 8 by the stitch cams 4', i.e., in clearing a new stitch, is such that the heads 5' are brought underneath an upper knocking-over plane 10' of the sinker 6'. At this time, the sinkers 6' located within the area of stitch formation are displaced by means of the cam 8'. Noses 11' of the sinkers 6' thereby enable the yarn to be laid into the needle heads 5', and new stitches to be drawn over the knocking-over plane 10'.

Upon formation of the last course of the tubular portion 1 (preferably by using an elastic yarn), the auxiliary cam 12' is brought into the inclined position shown in FIG. 21. As a result, the needles 8 are lowered, at the location of the stitch cam 4', by means of the so-adjusted auxiliary cam 12' into a position in which the needle heads 5' are located below a lower knocking-over plane 13' of the sinkers 6. While the needles 8 are being thus lowered, the sinkers 6' are simultaneously displaced by means of the bolt cam 14', so that a projection 15' on the sinker 6' is moved beyond the needle head 5'.

The needles 8 lowered by means of the auxiliary cam 12' correspondingly lower the now-knit tubular portion 1 to the second knocking-over plane 13'. When this is done, the sinkers 6' are moved back by the action of the cam 16', so that the projections 15' of the sinkers 6' engage and hold the tubular portion 1 on the plane 13', so that on the return upward movement of the needles 8 under the urging of the raising cam 3' located downstream of the cam 12', the knit tubular portion 1 remains in an inoperative position on the needle shafts. In this manner, the portion 1 remains in an inoperative position, while the heads 5' of the needles 8 are freed to perform a successive knitting operation.

Figure 22:
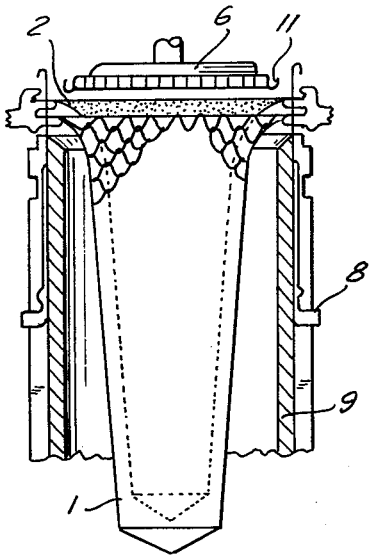
FIG. 22 is an elevational view in section of the dial and needle portion of the knitting machine immediately after a second tubular limb portion of the garment has been produced within and concentric to the first tubular limb portion.
Figure 23:
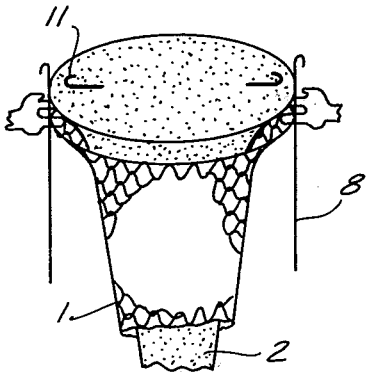
FIG. 23 is a perspective view of the upper portion of the arrangement of FIG. 22.

The tubular limb portion 2 is then knit on the needles 8 in exactly the same manner as described above for the case of the tubular portion 1; and FIGS. 22–23 illustrate the positions of the now-knit portions 1 and 2 prior to knitting the last course of the portion 2. As indicated, the portion 2 is situated coaxially within the tubular portion 1.

Figure 24:
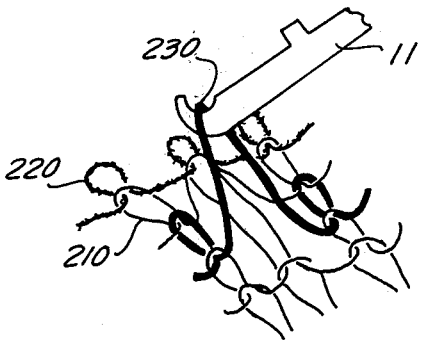
FIG. 24 is an enlarged view of the dial portion of the machine of FIGS. 22–23, illustrating how the second tubular limb portion may be suspended on the transfer jacks of the knitting machine.
Figure 25:
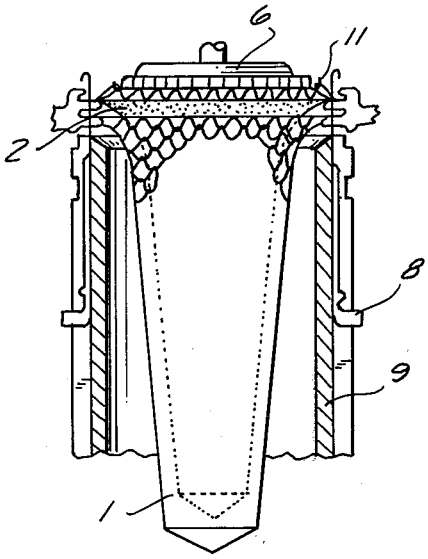
FIG. 25 is an elevational view in section, similar to FIG. 22, illustrating the garment in process after the second tubular portion has been transferred to the transfer jacks of the machine.
Figure 26:
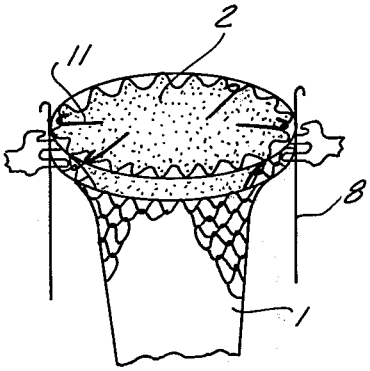
FIG. 26 is a perspective view of a portion of the arrangement of FIG. 25.

After the last course of the portion 2 is knit, it is transferred to and retained on the transfer jacks 11 in the manner depicted in FIG. 24. In particular, when knitting a last course 230 of the tubular portion 2 (such course being indicated by a bold line in FIG. 24), the transfer jacks 11 are disposed as shown in their forward position between the needles 8. As a result, yarn is fed also into the hooks of the transfer jacks 11 which, upon drawing the stitches, are so displaced that the loops between the stitches remain suspended from the hooks of the transfer jacks 11; while the stitches themselves remain on the needles 8 (FIGS. 25–26).

Figure 27:
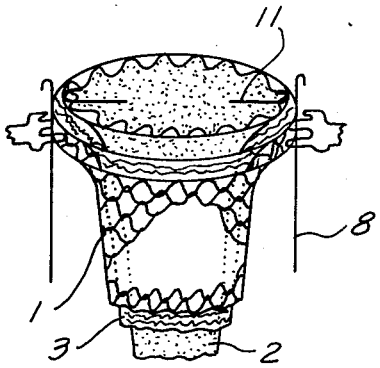
FIG. 27 is a perspective view, similar to FIG. 26, illustrating a third tubular body portion disposed coaxially between the previously knitted first and second limb portions.
Figure 28:
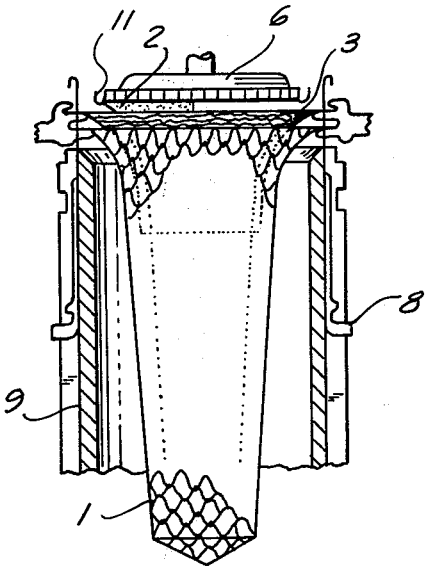
FIG. 28 is an elevational view of the machine during the transfer of the suspended second limb portion from one half of the dial periphery onto the corresponding portion of the needle cylinder.
Figure 29:
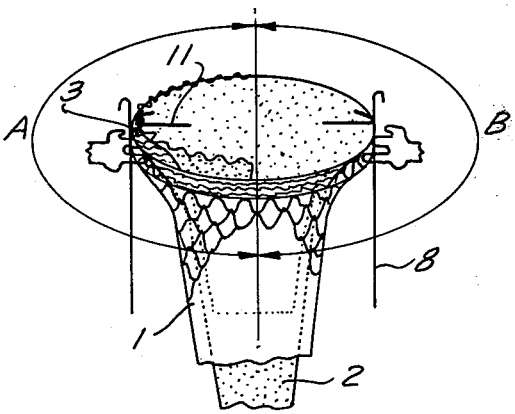
FIG. 29 is a perspective view of the upper portion of FIG. 28.
Figure 31:
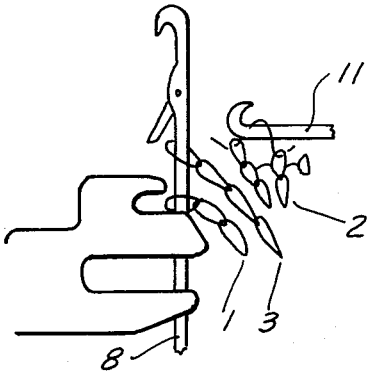
FIGS. 30–31 are enlarged perspective views of the dial portion of FIGS. 28–29.
Figure 30:
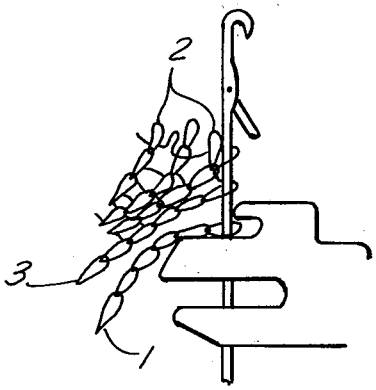

Thereafter, a number of securing courses 210, 220 (FIG. 24) are conventionally knitted to secure the border of the tubular portion 2 against unravelling. Thereafter, the tubular portion 2 is knocked off the needles 8, but remains suspended (by the loops of the last course 230) from the jacks 11. Since the tubular portion 2 is now held by the jacks 11, and since as indicated above the tubular portion 1 is disposed in an inoperative position on the shanks of the needles 8, such needles are now free to knit the tubular body portion 3 (FIG. 27) in the same manner as that described above, starting from the waist opening in the form of an elastic welt 12. After knitting the necessary length, three tubular portions 1, 2, 3 knitted in each other are retained in the following manner (see FIG. 2):

Tubular portion 1 for one limb on the shanks of needles 8 is now in inoperative position.

Tubular portion 2 for the other limb is on the transfer jacks 11, and tubular portion 3 for the body part is on the needles 8 in operative position between the tubular portions 1, 2 for the limbs.

Figure 1:
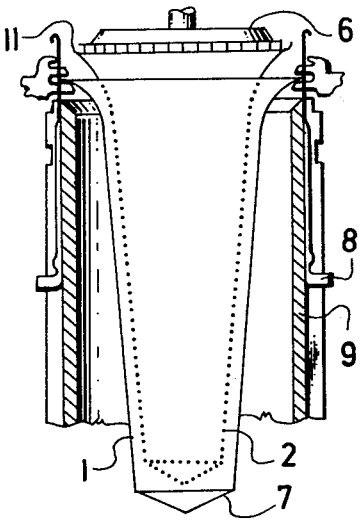
FIG. 1 illustrates the retainment of finished tubular portions for the limbs in a circular knitting machine.
Figure 2:
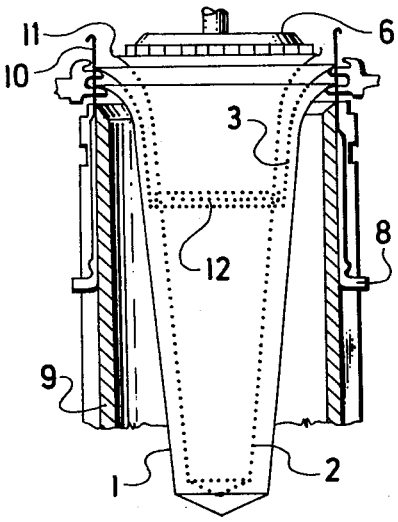
FIG. 2 illustrates the positioning of retained finished tubular limb portions and the body part in a circular knitting machine before joining their borders.

As clearly indicated in FIG. 2, the portions 3 and 2 are now successively disposed inwardly of the tube 1, with the outwardly facing surface of the portion 3 confronting the inwardly facing surface of the portion 1, and the outwardly facing surface of the portion 2 confronting the inwardly facing surface of the portion 3.

Figure 5:
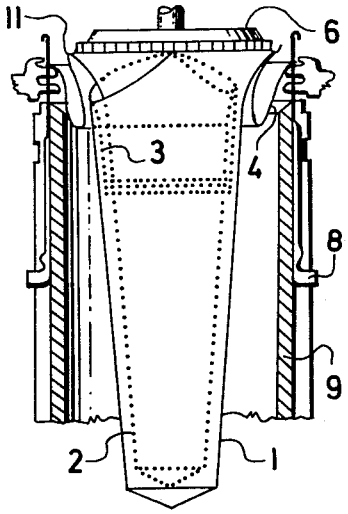
FIG. 5 illustrates the forming of a portion in the form of a closed toe by means of which the tubular limb portions are joined.

The three tubular portions 1, 2 and 3 are now joined together as follows: Firstly, as indicated best in FIGS. 28–31, the region of the tubular portion 2 suspended from the jacks 11 is transferred from the half B of the circumference of the dial 6 onto the needles 8 located on the adjacent half B of the needle cylinder 9; the remaining regions of the tubular portion 2, i.e., located on the half A of the circumference of the dial 6, is left suspended on the jacks 11. A connecting course 5 (FIGS. 3 and 5) is then knitted to join the tubular portions 2 and 3 on the half B of the circumference of the needle cylinder 9, followed by the conventional knitting of a few securing courses therebetween. The knitted-together tubular portions 2 and 3 are then knocked off the needles 8 on the half B of the circumference of the needle cylinder 9.

Figure 32:
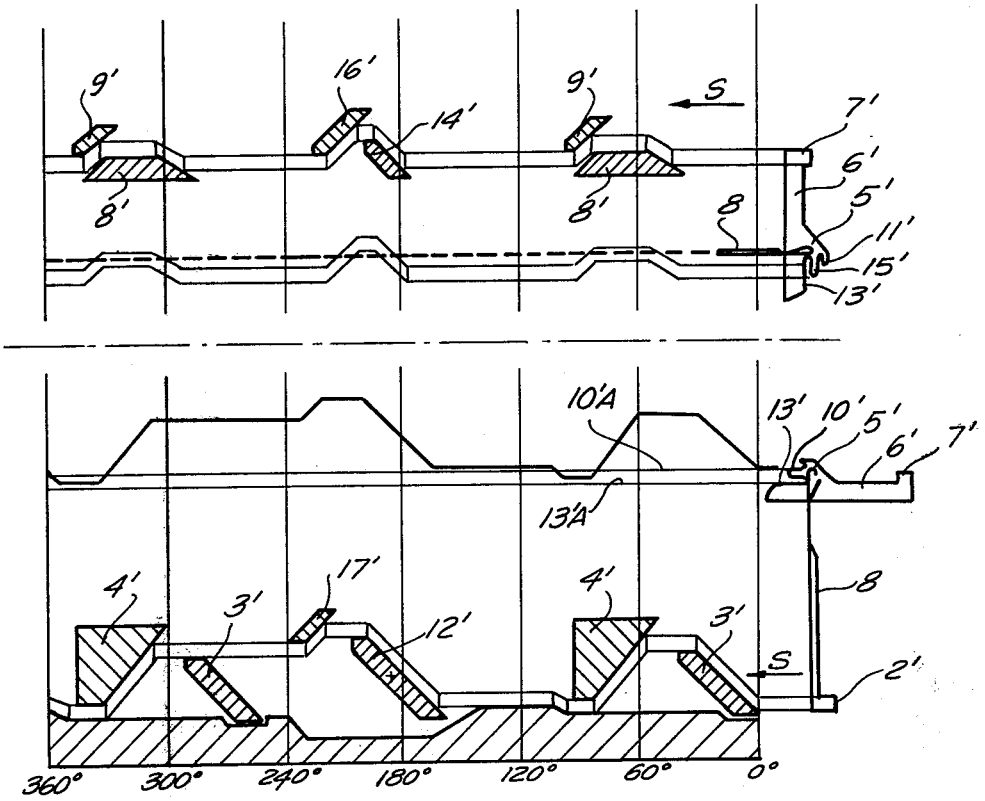
FIG. 32 is a schematic representation of the cam system of FIGS. 20–21, when such system is adjusted to transfer the previously-knit first limb portion back to the operating portions of the needles.

After the now-joined tubular portions 2 and 3 are knocked off the half B of the circumference of the needle cylinder 9, the previously knitted tubular portion 1, held in inoperative position on the shanks of the needles 8, are lifted into an operative position for cooperation with the region of the tubular body portion 3 that is still suspended from the needles 8 on the half A of the circumference of the needle cylinder 9. Such movement is accomplished by adjusting the auxiliary cam 12' from the position shown in FIG. 21 to that shown in FIG. 32.

In this latter position, the needles 8 are raised by the cam 12′ in the area from which the projections 15′ of the sinkers 6 has been displaced by means of the cam 14′, thereby permitting the projection 15′ to reach a position beyond the needle head 5′.

Upon the lifting of the tubular portion 1 into its operative position at the upper knocking-over plate 10′, the sinker 6′ is returned into its initial position by means of the cam 16′ so that, on subsequent movement of the needles 8 by means of the cam 17′, the portion 1 is retained in its operative position.

Figure 34:
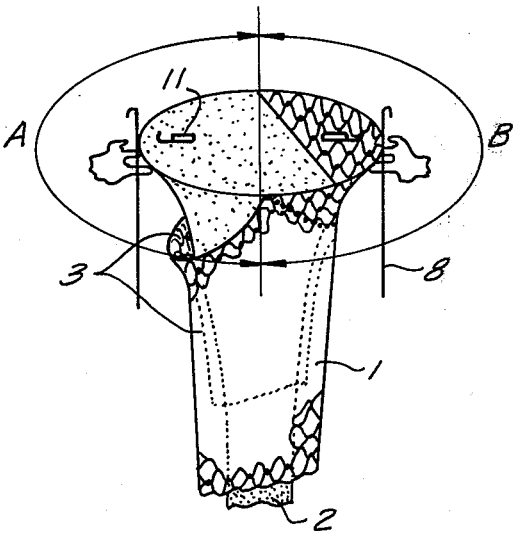
FIGS. 33–34 are perspective views of FIGS. 3–4, illustrating how the tubular limb and body portions are joined together prior to the incorporation of a closed-toe crotch portion.
Figure 33:
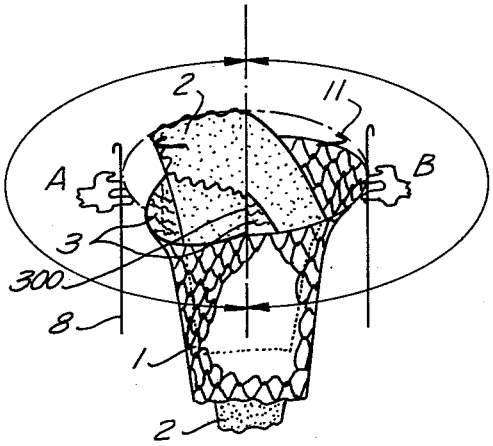

After this, a second course 5 (FIG. 3) is knitted to join the tubular portions 1 and 3 on the half A of the circumference of the needle cylinder 9, after which a few more securing courses are conventionally knitted. Following such joining, the portions 1 and 3 are knocked off the needles 8 on the half A of the circumference of the needle cylinder 9, and thereby assume the position shown in FIGS. 33–34; the line represented by the reference numeral 300 in FIG. 33 represents the loops between adjoining stitches of the tubular portions 3, 2.

After the knocking-off operation, the unjoined regions of the tubular portion 2 still remain suspended from the transfer jacks on the half A of the circumference of the dial, whereas the unjoined border of the tubular portion 1 remains suspended from the needles on the half B of the circumference of the needle cylinder 9.

Figure 4:
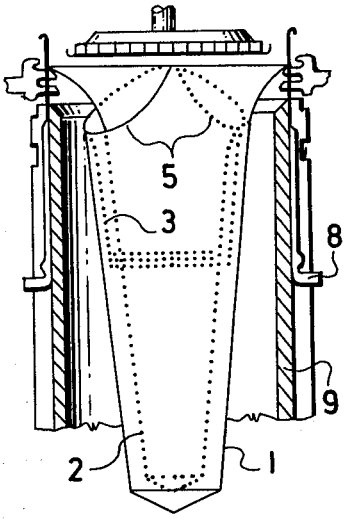
FIG. 4 is a view similar to FIG. 1 showing the arrangement of the tubular portions, of which the joined border parts of tubular limb portions and those of the tubular portion for the body part were knocked off the needles before joining the tubular portions for the limbs.
Figure 35:
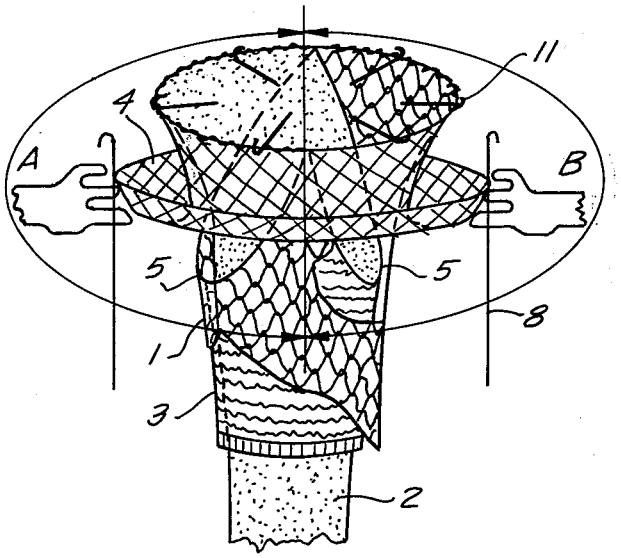
FIG. 35 is a perspective view of FIG. 6, illustrating how the closed-toe crotch portion is joined to the previously-knitted tubular limb portions.

Next, the tubular portion 2 is now transferred from the transfer jacks 11 located on the half A of the circumference of the dial 6, onto the needles 8 located on the half A of the circumference of the cylinder 9, and is suspended therefrom. The suspended portions of the unjoined halves of the portions 2 and 1 on the respective halves A and B on the needle cylinder 9 are clearly shown in FIG. 34, which provides a perspective view of FIG. 4. At this time, the unjoined suspended borders of the portions 1 and 2 are joined by a crotch portion 4 in the manner shown in FIG. 35, the latter having been knitted in the manner described above in connection with the closed toe portion 7 of FIGS. 14–17. Prior to the attachment of the crotch portion 4 to the portions 1 and 2, the garment has the configuration shown in FIG. 3.

When the knitting of the crotch portion 4 is completed (FIG. 35), the dial of the transfer jacks 11 is now turned through more than 180° with respect to the needle cylinder 9. After this angular rotation, the border of the crotch portion 4 held on the transfer jacks 11 is transferred back onto the needles 8, and a number of courses are knitted to reduce the tendency of the crotch portion to unravel. After this, the crotch portion 4 may be knocked off the needles 8.

Figure 11:
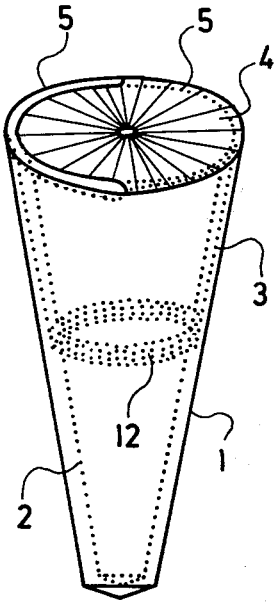
FIG. 11 is a view of the panties in folded state upon leaving the knitting machine.
Figure 12:
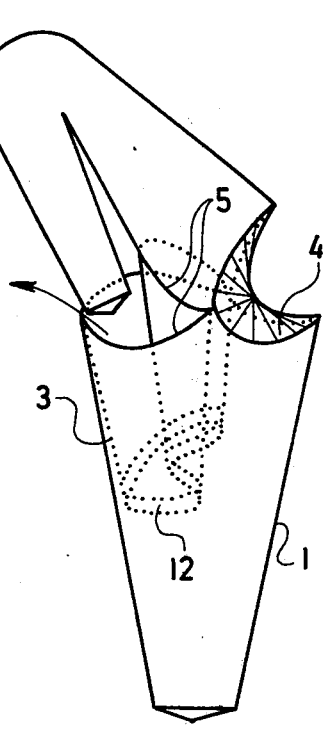
FIG. 12 illustrates the unfolding of the panties.
Figure 6:
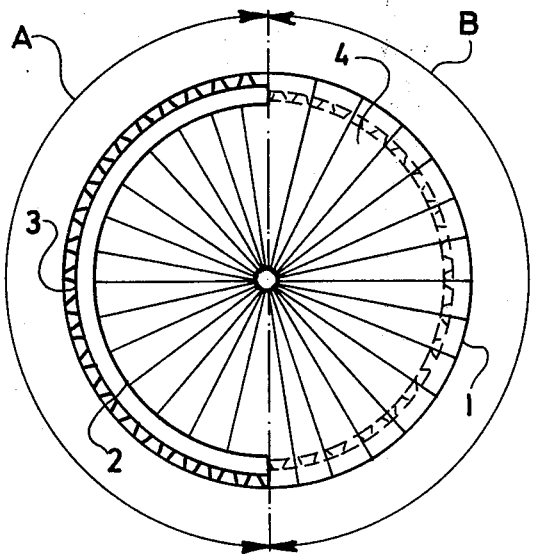
FIG. 6 is a plan view of the finished panties in assembled condition.
Figure 14:
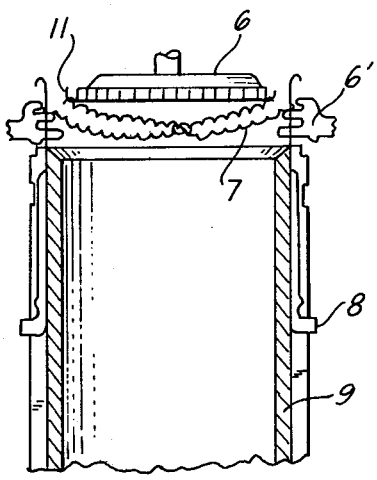
FIG. 14 is an elevational view in section of a portion of a knitting machine illustrating how opposite borders of a closed toe portion may be held between the needles and transfer jacks of the knitting machine.
Figure 15:
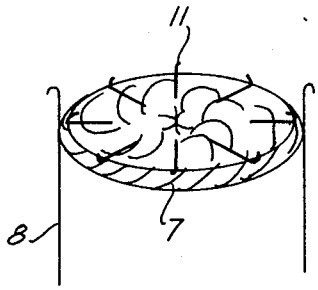
FIG. 15 is a perspective view of the upper portion of the arrangement of FIG. 14.

At this time, the final configuration of the knitted garment before removal from the machine is depicted in FIGS. 6 and 11; the garment can then be unfolded in the manner shown in FIG. 12 to arrive at the final configuration shown in FIG. 13.

As will be evident from a consideration of FIGS. 2 and 11–13, the outwardly facing surfaces of both of the limb portions 1 and 2 will remain in an outwardly-facing direction after unfolding, thereby providing a pleasing appearance and permitting arbitrary patterning.

Figure 7:
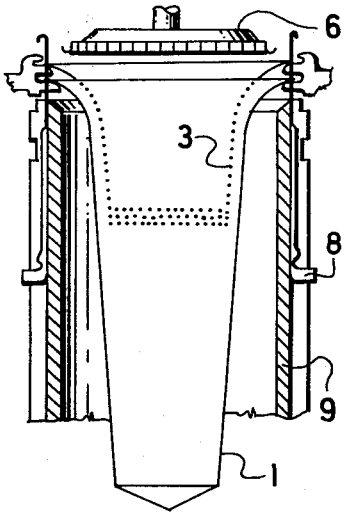
FIG. 7 illustrates the retainment of a tubular portion on the needle shanks in inoperative position for one limb immediately before finishing the tubular portion for the body part in another sequence of knitting tubular portions.

The sequence of knitting tubular portions 1, 2, 3 may be changed in such manner (see FIG. 7), that at first there is knitted tubular limb portion 1, which is secured on its border against unravelling, and is retained only on the shanks of a part of needles 8 in inoperative position, e.g., on each fourth needle 8 and is knocked off the remaining needles 8.

Figure 8:
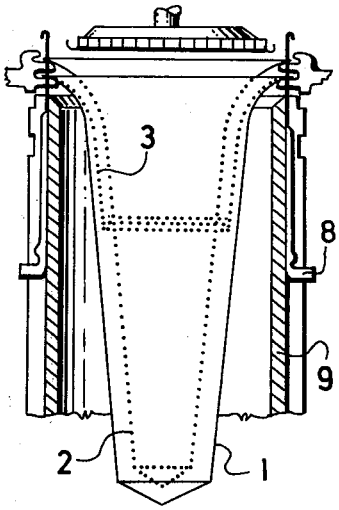
FIG. 8 illustrates the retainment of tubular portions for one limb and the body part from the arrangement of FIG. 7 on the needle shanks in inoperative position after finishing the tubular portion for the second limb.
Figure 9:
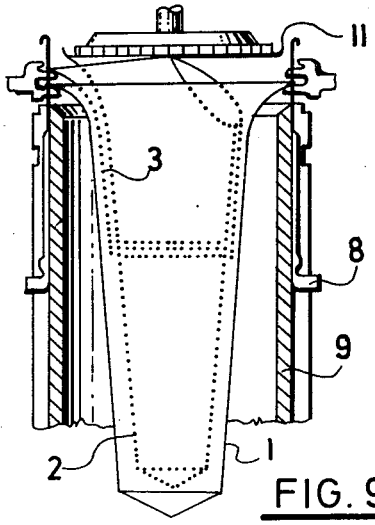
FIG. 9 illustrates the joining of one tubular portion for the limb with the body portion, the second tubular limb portion being on the needle shanks in inoperative position.

Tubular portion 3 for the body part is knitted by using all needles 8 as in the preceding case, and, in order to avoid securing of its border against unravelling, is retained on the shanks of all needles 8 in inoperative position, on which there is thereafter knitted tubular limb portion 2 (see FIG. 8) which is then on a part of the border circumference entrapped on the transfer jacks 11 of circumference A, and after being secured against unravelling is knocked off needles 8. Now, the tubular portion 3 is displaced from the shanks of needles 8 in inoperative position to needles 8 into operative position (by "operative" is meant the position of the loops on the needles making knitting possible) and is joined by knitting a connecting course on a part of the circumference of border B with a part of the border of tubular portion 2 for the limb. After securing the said connecting course against unravelling, the borders connected on part B of the circumference are knocked off needles 8 (see FIG. 9). Now, tubular limb portion 1 is displaced from the shanks of needles 8 from an inoperative position into an operative position on needles 8, said tubular limb portion 1 being retained on the outer side of tubular portion 3 for the body part, and, by knitting a connecting course, said tubular portions 1, 3 are joined on part A of circumference and are knocked off needles 8 by securing said connecting course. The joining of tubular portions 1, 2 for limbs by part 4 in the form of a closed toe is performed in a manner analogous to the preceding case.

It should be understood that the panties of the invention can be manufactured even in a circular knitting machine in which it is not possible to retain any tubular portion 1, 2, 3 on the shanks of needles 8 in an inoperative position. It is possible, e.g., to proceed in such manner that the knitting of tubular limb portion 1 is started by using a part of needles 8 of needle cylinder 9, e.g., on each second needle 8 of needle cylinder 9 and said tubular portion 1 is finished after achieving the necessary length with a higher number of needles 8, e.g., in such manner that only each fourth needle 8 of needle cylinder 9 is not involved into the knitting process (that is, is in its continuous position). After knitting the border, this is secured against unravelling and the secured border is relieved from at least a part of needles 8 necessary for knitting tubular limb portion 2, while the knitted tubular limb portion 1 remains retained on the remaining needles 8, in the given case on one quarter of needles 8 of needle cylinder 9 being situated in their continuous position.

Upon knitting tubular limb portion 2, a procedure is followed similar to that employed in knitting tubular portion 1 but with the difference that the border may be secured only by using, e.g., three-quarters of the needles of needle cylinder 9. Further, tubular limb portion 2 is retained on transfer jacks 11 and knocked off all needles 8 which knitted said portion. On a part of needles 8 in continuous position (each fourth needle), there is retained tubular limb portion 1, while tubular portion 2 for the other limb is retained on transfer jacks 11. Now on all free needles 8, e.g., when considering a division of three-quarters of needles of the needle cylinder, there is knitted the tubular portion 3 for the body part including the elastic welt 12.

Figure 10:
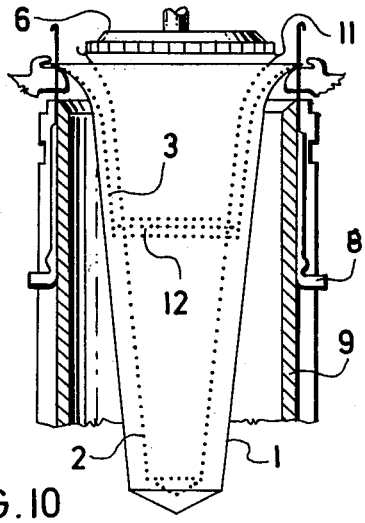
FIG. 10 illustrates a method of retaining tubular portions on the needles in continuous position and on transfer jacks.

Upon knitting tubular portion 3 for the body part tubular portion 1 for the limb is retained in continuous position on needles 8, tubular limb portion 2 is retained on transfer jacks 11, and tubular portion 3 for the body part (see FIG. 10) is retained on needles 8 in operative position.

Figure 3:
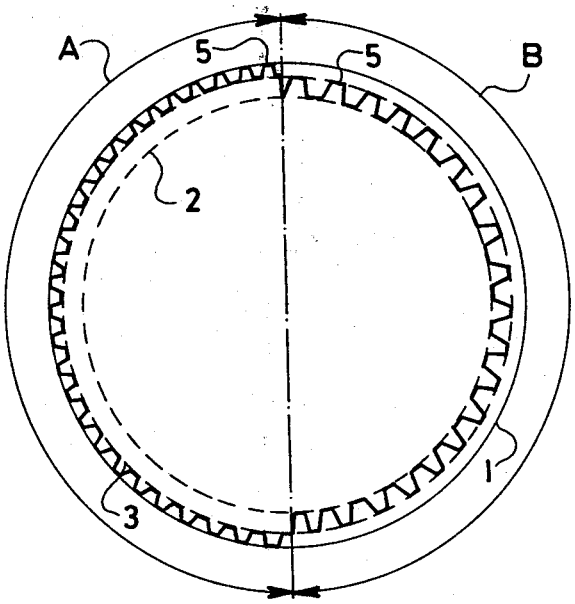
FIG. 3 is a view in plan of an arrangement of the tubular portions in a circular knitting machine after joining the parts of the borders of tubular limb portions with the border of the tubular portion for the body part.

Further, knitting is continued in such manner that at first there are transferred on a part of the border circumference the loops of tubular limb portion 2 from the transfer jacks 11 back to needles 8 and then, on a part of circumference 8 the tubular portion 3 for the body part is joined by a connecting course with tubular limb portion 2 at its inner side and on part of circumference A with the other limb portion 1 at its outer side (FIG. 3). The joined loops of tubular portions 1, 2, 3 are then knocked off needles 8. As a result, on one part of circumference B on needles 8 there is retained tubular limb portion 1, while on the remaining part of circumference A of needle cylinder 9 all needles 8 are free. To these free needles 8 there is transferred a part of the circumference A on the border of tubular limb portion 2 retained on transfer jacks 11. Both tubular portions 1, 2 are then joined by part 4 formed in the form of a closed toe part in the same manner as already mentioned in the preceding knitting procedures for panties.

Upon knitting by using a part of needles 8 of needle cylinder 9, it is possible to knit in a manner similar to the knitting of panties by using all needles 8 of needle cylinder 9, the tubular portion 3 for the body part as the second portion, and to retain said portion after knitting on a reduced number of needles 8 brought into a continuous position similar to the tubular limb portion 1 knitted before. For retaining the tubular portions, it is necessary to use various needles 8 and only in such number that the last knitted tubular limb portion 2 shall be formed on a sufficient number of needles 8. Upon joining, the same procedure is used as upon retaining tubular portions 1, 3 on shanks of needles 8 in inoperative position.

In part 4 joining tubular limb portions 1, 2 a type of closed toe obtained by overtwisting the tubular knitwork may be employed in the exemplary embodiments. The said portion 4 can be closed, or possibly directly joined with the borders of tubular limb portions 1, 2 and in other manners, as e.g., in French Pat. No. 2,145,273.

After knitting, it is necessary to unfold the folded panties (FIG. 11). The procedure is obvious from FIG. 12. The unfolded panties (FIG. 13) have their outer sides of tubular limb portions 1, 2 similarly directed, i.e., both undersides and both face sides, while tubular portion 3 is reversed relative to them. However, it is also possible to provide tubular portion 3 for the body part with the same orientation or direction of its inner and outer sides as tubular limb portions 1, 2. In this case it is necessary to knit this portion by the known double welt method.

Although the invention has been illustrated and described with reference to a plurality of embodiments of panties and methods of making same, it is to be expressly understood that it is in no way limited by the disclosure of such a plurality of embodiments, but is capable of numerous modifications within the scope of the appended claims.

What is claimed is:

1. A folded, knitted pantyhose garment comprising first and second tubular limb portions, a third tubular body portion, and a crotch portion having an outer periphery, the first, second and third portions having mutually joined first open ends, the first, third and second portions being arranged substantially coaxially one within the other in radial inward succession with their respective first ends facing in the same direction, the inwardly facing surface of the outermost first portion confronting the outwardly facing surface of the third portion, the outwardly facing surface of the innermost second portion confronting the inwardly-facing surface of the third portion, a first half of the circumference of the first end of the third portion being joined directly to a corresponding adjacent first half of the circumference of the first end of the first portion, the remaining half of the circumference of the first end of the third portion being joined directly to the adjacent half of the circumference of the first end of the second portion, the remaining halves of the circumference of the first ends of the respective first and second portions being joined by the outer periphery of the crotch portion, whereby the above-mentioned outwardly-facing surfaces of the first and second portions of the folded garment remain the outwardly-facing surfaces of said portions when the garment is unfolded.

2. A garment as defined in claim 1, in which the crotch portion is in the form of a closed toe.

3. A method of manufacturing a pantyhose garment on a circular knitting machine, comprising the steps of knitting substantially identical first and second tubular limb portions, a third tubular body portion, and a crotch portion in the form of a closed toe, the first, second and third portions respectively having first open end adapted to cooperate with each other and with the crotch portion to define the finished garment; supporting the knitted first, third and second portions of the garment in substantially coaxial relation one within the other in radial inward succession with the first ends of the portions facing in the same direction; directly joining a first half of the circumference of the first end of the third portion to a corresponding adjacent half of the circumference of the first end of the first portion; directly joining the remaining half of the circumference of the first end of the third portion to a corresponding adjacent half of the circumference of the first end of the second portion; and joining the other respective halves of the circumference of the first ends of the respective first and second portions to the outer periphery of the crotch portion.

4. A method as defined in claim 3, in which the knitting step comprises defining the ends of the first and second portions opposite the respective first ends thereof as closed toes.

5. Method of manufacturing panties as claimed in claim 4, wherein all three tubular portions are knitted by using all needles of the needle cylinder, the tubular limb portions being knitted first, the first formed tubular limb portion being retained on the shanks of the needles in an inoperative position, the second formed limb portions being retained on transfer jacks, the free needles being used thereafter for knitting the tubular portion for the body part, all said tubular portions being joined, upon finishing the tubular portion for the body part, by knitting, the appurtenant part of the border of the tubular limb portions being transferred from the transfer jacks to the needles and the tubular portion for the body part being transferred from the shanks of the needles from an inoperative position to an operative position.

* * * * *